US012252362B2

(12) United States Patent
Yamamoto

(10) Patent No.: US 12,252,362 B2
(45) Date of Patent: Mar. 18, 2025

(54) SHEET SUPPLY DEVICE

(71) Applicant: TOSHIBA TEC KABUSHIKI KAISHA, Tokyo (JP)

(72) Inventor: Mikio Yamamoto, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 345 days.

(21) Appl. No.: 17/750,519

(22) Filed: May 23, 2022

(65) Prior Publication Data

US 2023/0406652 A1 Dec. 21, 2023

(51) Int. Cl.
*B65H 1/26* (2006.01)
*B65H 1/04* (2006.01)

(52) U.S. Cl.
CPC ..... *B65H 1/266* (2013.01); *B65H 1/04* (2013.01); *B65H 2402/32* (2013.01); *B65H 2402/60* (2013.01); *B65H 2801/06* (2013.01)

(58) Field of Classification Search
CPC ..... B65H 2402/32; B65H 2402/35; B65H 1/266; A47B 88/473
See application file for complete search history.

(56) References Cited

U.S. PATENT DOCUMENTS 6,076,906 A * 6/2000 Royal ..... H05K 7/1421 312/273
9,052,039 B2 * 6/2015 Mettee, II ..... B29C 48/20
9,671,736 B2 * 6/2017 Hayayumi ..... G03G 21/1638
2016/0231692 A1 8/2016 Hayayumi
2021/0300089 A1 9/2021 Yamamoto

FOREIGN PATENT DOCUMENTS

JP 2008-050081 3/2008

* cited by examiner

*Primary Examiner* — Howard J Sanders
(74) *Attorney, Agent, or Firm* — Amin, Turocy & Watson, LLP

(57) ABSTRACT

A sheet supply device includes a cassette, a housing, a first roller, and a first rib. The cassette is capable of accommodating a sheet. The housing movably supports the cassette in a first direction. The first roller is supported by the housing. The first roller is rotatable about a rotation axis parallel to a second direction orthogonal to the first direction. The first roller includes a pair of flanges spaced apart from each other in the second direction. The first rib protrudes downward from the cassette. The first rib has a lower end surface in contact with the first roller between the pair of flanges. The first rib extends in the first direction. The first rib has a first width of a first portion in the second direction wider than a second width of a second portion in the second direction. The first portion is disposed between the pair of flanges in a state where the cassette is accommodated in the housing. The second portion is disposed between the pair of flanges in a state where the cassette is pulled out from the housing.

20 Claims, 9 Drawing Sheets

SHEET SUPPLY DEVICE

FIELD

Embodiments described herein relate generally to a sheet supply device and an image forming apparatus.

BACKGROUND

An image forming apparatus forms an image on a sheet. The image forming apparatus includes a sheet supply device that supplies the sheet. The sheet supply device includes a cassette and a housing. The cassette is capable of accommodating the sheet. The housing movably supports the cassette in a first direction. The cassette moves in the first direction to be accommodated in the housing. There is a demand for a sheet supply device capable of preventing a load when the cassette is to be accommodated in the housing.

DETAILED DESCRIPTION

In general, according to one embodiment, a sheet supply device includes a cassette, a housing, a first roller, and a first rib. The cassette is capable of accommodating a sheet. The housing movably supports the cassette in a first direction. The first roller is supported by the housing. The first roller is rotatable about a rotation axis parallel to a second direction orthogonal to the first direction. The first roller includes a pair of flanges spaced apart from each other in the second direction. The first rib protrudes downward from the cassette. The first rib has a lower end surface in contact with the first roller between the pair of flanges. The first rib extends in the first direction. The first rib has a first width of a first portion in the second direction wider than a second width of a second portion in the second direction. The first portion is disposed between the pair of flanges in a state where the cassette is accommodated in the housing. The second portion is disposed between the pair of flanges in a state where the cassette is pulled out from the housing.

Hereinafter, the sheet supply device according to the embodiment will be described with reference to the drawings.

Figure 1:
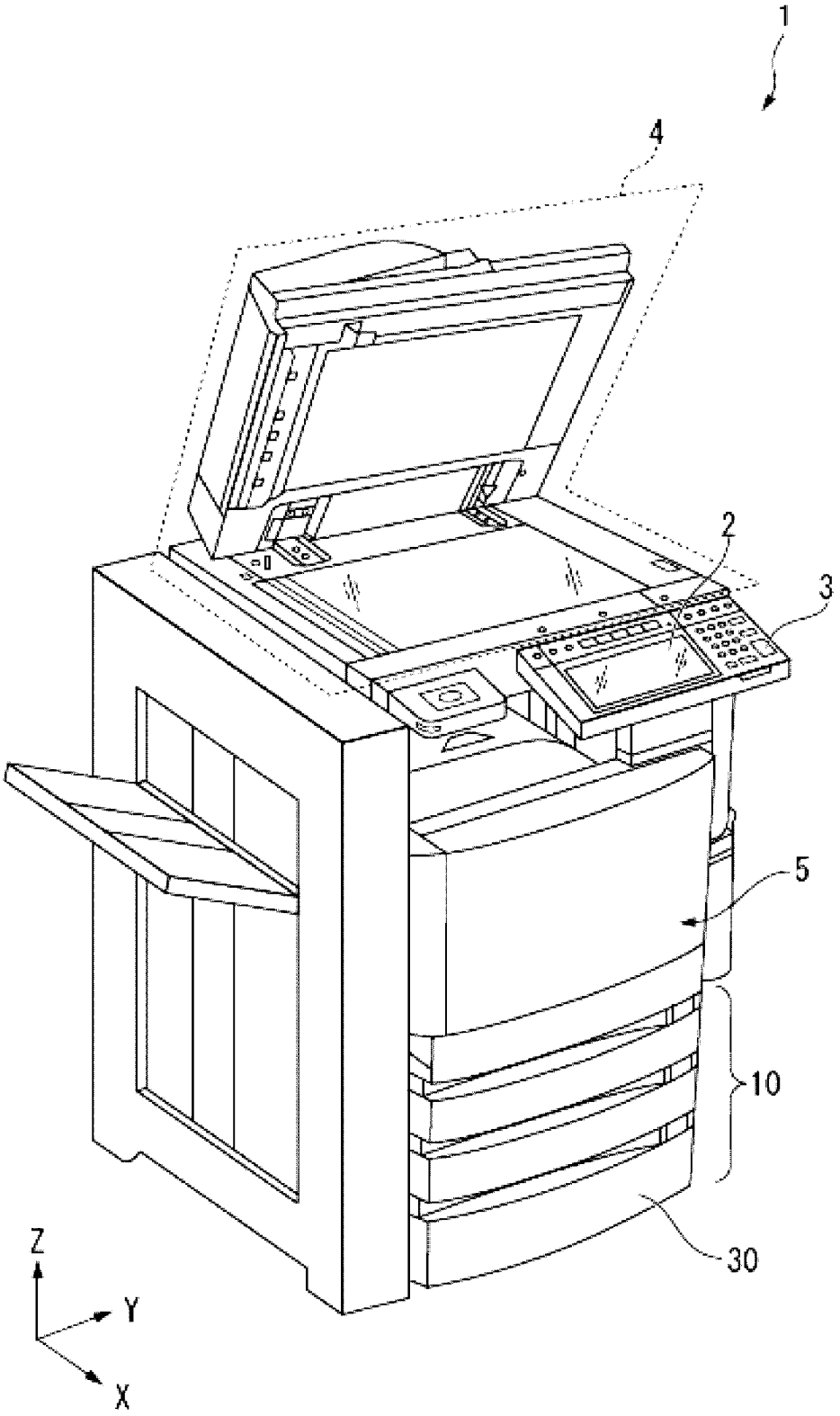
FIG. 1 is a perspective view of an image forming apparatus.

FIG. 1 is a perspective view of an image forming apparatus 1. In the present application, a Z direction, an X direction, and a Y direction of an orthogonal coordinate system are defined as follows. The Z direction is a vertical direction, and a +Z direction is an upward direction. The X direction and the Y direction are horizontal directions. The X direction (first direction) is a front-rear direction of the image forming apparatus 1, and a +X direction is a front direction. The Y direction (second direction) is a left-right direction of the image forming apparatus 1. A +Y direction is a direction in which the sheet accommodated in a cassette 30 is supplied.

The image forming apparatus 1 forms an image on a sheet. For example, the image forming apparatus 1 is a multi function printer (MFP), a copying machine or the like. The image forming apparatus 1 may perform an image processing on the image formed on the sheet. Examples of the image processing using the image forming apparatus 1 include erasing an image formed with a decolorable toner by heating or the like.

The image forming apparatus 1 includes a display 2, a control panel unit 3, an image reading unit 4, an image forming unit 5, and a sheet supply device 10.

The display 2 and the control panel unit 3 are used by a user to input an operation for operating the image forming apparatus 1. The display 2 displays contents of an operation performed by the user and a message to the user.

The image reading unit 4 reads a document and forms an image signal of the image formed by the image forming unit 5.

The image forming unit 5 forms the image on the sheet based on the operation input or a signal from an outside.

The sheet supply device 10 is disposed at a lower portion of the image forming apparatus 1. The sheet supply device 10 supplies the sheet to the image forming unit 5.

Figure 2:
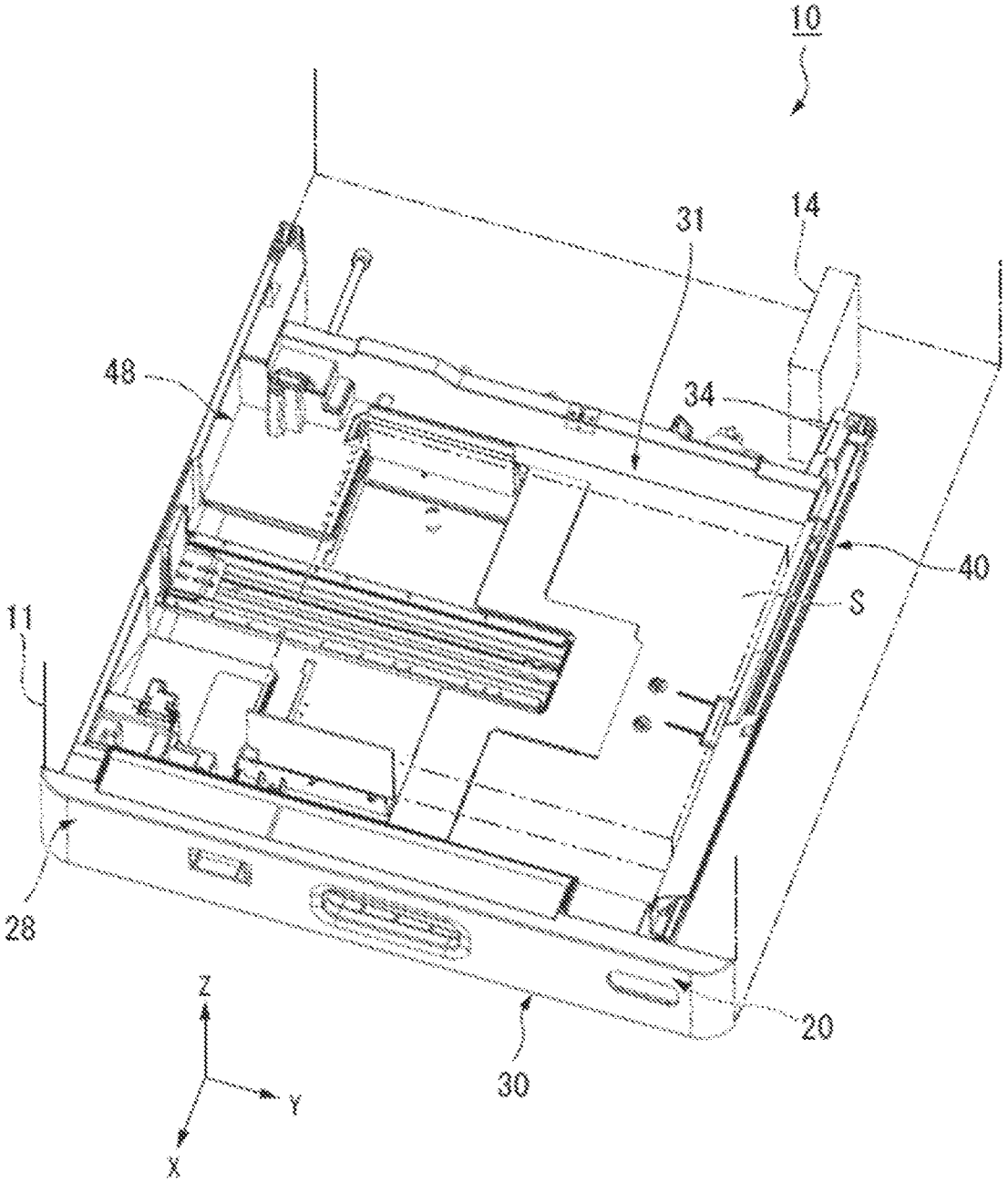
FIG. 2 is a perspective view of a sheet supply device as viewed from above.

FIG. 2 is a perspective view of the sheet supply device 10 according to the embodiment as viewed from above. The sheet supply device 10 includes the cassette 30 and a housing (frame) 11.

The cassette 30 has a box shape whose upper surface is open. The cassette 30 includes a sheet accommodating portion 31 capable of accommodating sheets S. The sheets S accommodated in the sheet accommodating portion 31 are supplied to the image forming unit 5 one by one by a pickup roller, a conveyance roller, and a separation roller. The sheets S are supplied from the cassette 30 in the +Y direction.

The cassette 30 includes a pair of ribs (rails) 40 and 48. The pair of ribs 40 and 48 protrude downward from the cassette 30. The pair of ribs 40 and 48 extend in the X direction. The pair of ribs 40 and 48 protrude from the sheet accommodating portion 31 in a −X direction. The pair of ribs 40 and 48 are a first rib 40 and a second rib 48. The first rib 40 is located at an end portion of the cassette 30 in the +Y direction. The second rib 48 is located at an end portion of the cassette 30 in the −Y direction. The second rib 48 is spaced apart from the first rib 40 in the Y direction.

The housing 11 movably supports the cassette 30 in the X direction. The cassette 30 moves in the +X direction to be pulled out from the housing 11. The cassette 30 moves in the −X direction to be accommodated in the housing 11. The user of the image forming apparatus 1 pulls out the cassette 30 from the housing 11 and replenishes the sheet S into the sheet accommodating portion 31. The user accommodates the cassette 30 in the housing 11, and causes the image forming apparatus 1 to start image formation.

The sheet supply device 10 includes a retracting device 14 that retracts the cassette 30 into the housing 11. The retracting device 14 is provided at an end portion of the housing 11 in the −X direction. A distance between the retracting device 14 and the first rib 40 in the Y direction is shorter than a distance between the retracting device 14 and the second rib 48 in the Y direction. The retracting device 14 is adjacent to the first rib 40 in the −Y direction. The first rib 40 includes a pin 34 at an end portion in the −X direction. The pin 34 protrudes in the −Y direction from the first rib 40.

At the time of accommodating the cassette 30, the user of the image forming apparatus 1 moves the cassette 30 in the −X direction. When the cassette 30 moves close to the end portion in the −X direction, the pin 34 enters the retracting device 14. The retracting device 14 retracts the pin 34 in the −X direction by using a restoring force of a biasing member or the like. Accordingly, the cassette is accommodated in the housing 11. The retracting device 14 assists accommodation of the cassette 30 by the user. The retracting device 14 accommodates the cassette 30 at a predetermined position of the housing 11. Accordingly, supply accuracy of the sheet S is improved.

The housing 11 includes a pair of rollers 20 and 28. The pair of rollers 20 and 28 are supported by the housing 11. The pair of rollers 20 and 28 are rotatable about a rotation axis parallel to the Y direction. Outer peripheral surfaces of the pair of rollers 20 and 28 are in contact with lower end surfaces of the pair of ribs 40 and 48. The pair of rollers 20 and 28 rotate upon movement of the cassette 30 in the X direction. The pair of rollers 20 and 28 reduce a moving load of the cassette 30 in the X direction. The pair of rollers 20 and 28 are a first roller 20 and a second roller 28.

Figure 3:
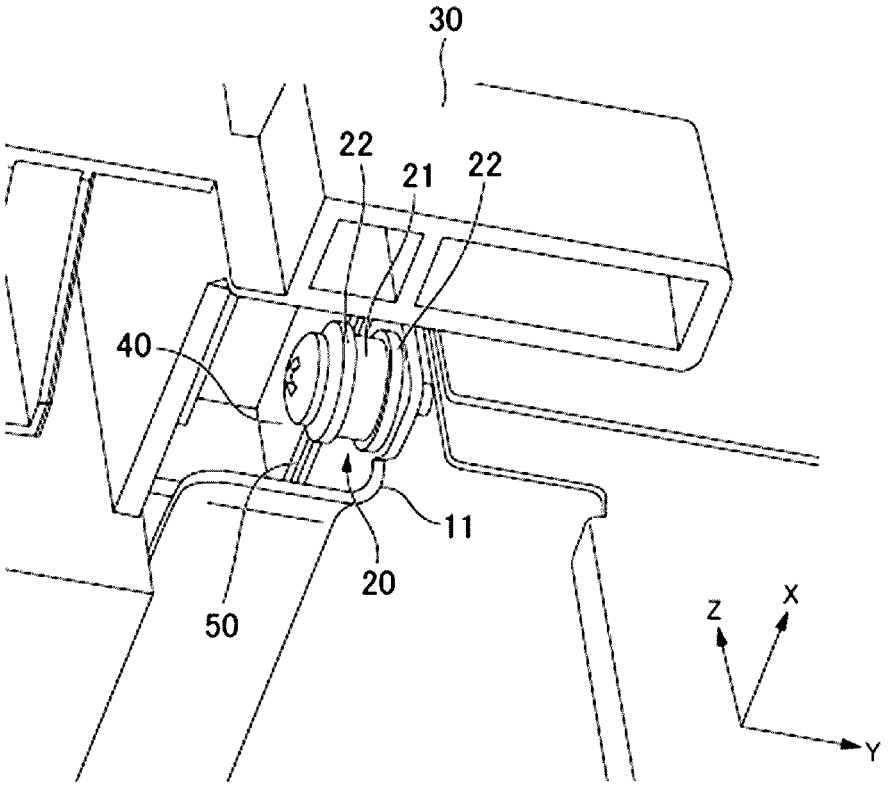
FIG. 3 is a perspective view of the sheet supply device as viewed from below.
Figure 4:
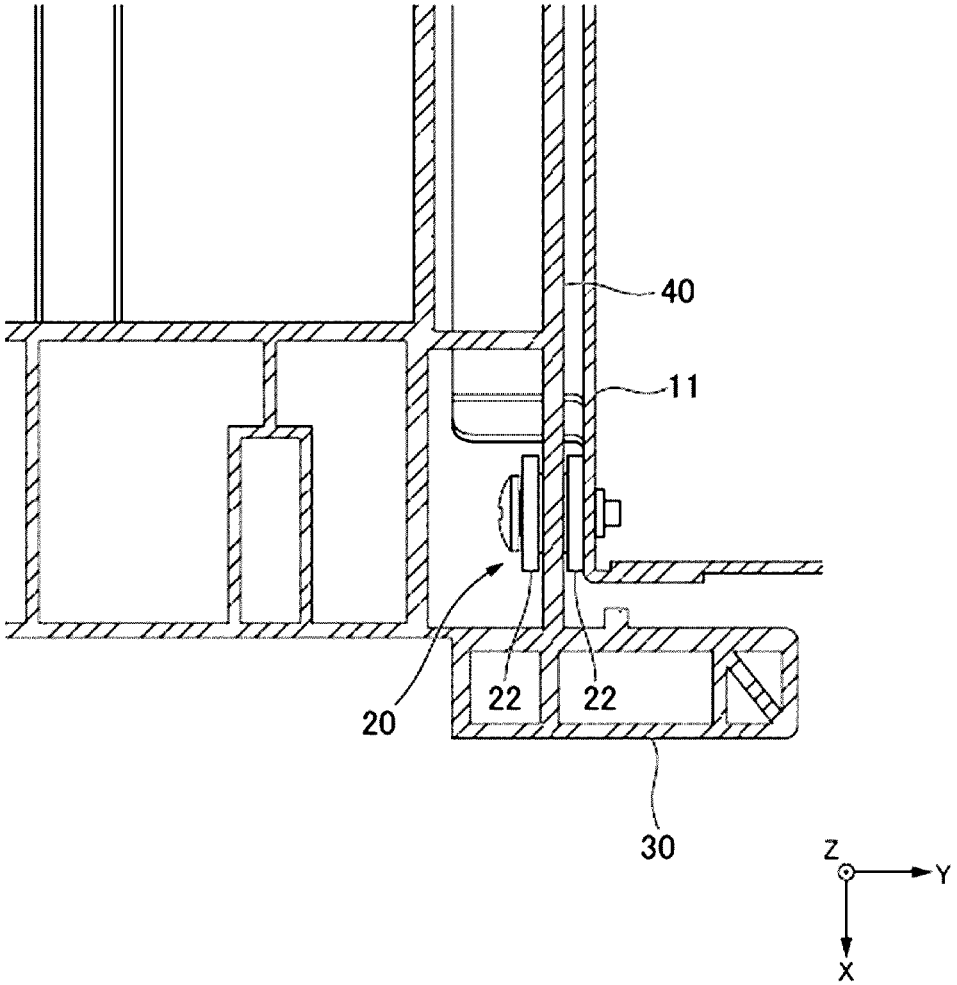
FIG. 4 is a plan sectional view of a periphery of a first roller.

FIG. 3 is a perspective view of the sheet supply device 10 as viewed from below. FIG. 4 is a plan sectional view of a periphery of the first roller 20. FIGS. 3 and 4 illustrate a state where the cassette 30 is accommodated.

The first roller 20 includes a cylindrical portion 21 and a pair of flanges 22. The cylindrical portion 21 has a cylindrical shape whose central axis is parallel to the Y direction. The lower end surface of the first rib 40 is in contact with an outer peripheral surface of the cylindrical portion 21.

The pair of flanges 22 are spaced apart from each other in the Y direction at both end portions of the cylindrical portion 21 in the Y direction. The pair of flanges 22 extend to an outer side of the first roller 20 in a radial direction from an outer periphery of the cylindrical portion 21. A diameter of an outer periphery of the pair of flanges 22 is larger than a diameter of the outer periphery of the cylindrical portion 21. The lower end surface of the first rib 40 is in contact with the first roller 20 between the pair of flanges 22.

Figure 5:
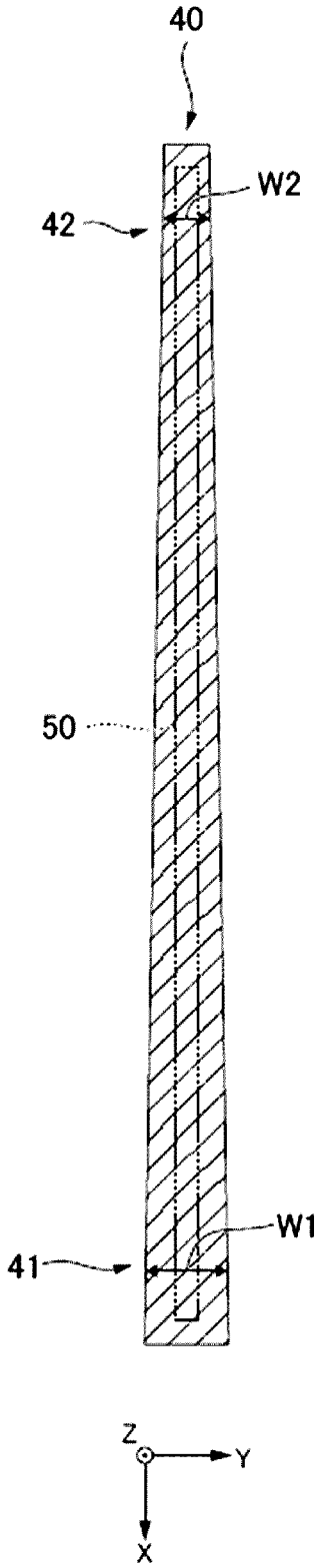
FIG. 5 is a plan sectional view of a first rib.

FIG. 5 is a plan sectional view of the first rib 40 according to the embodiment. A first portion 41 of the first rib 40 is disposed between the pair of flanges 22 in a state where the cassette 30 is accommodated in the housing 11. The first portion 41 is located near the end portion of the first rib 40 in the +X direction. A first width W1 of the first portion 41 in the Y direction is slightly smaller than an interval of the pair of flanges 22 in the Y direction.

A second portion 42 of the first rib 40 is disposed between the pair of flanges 22 in a state where the cassette 30 is pulled out from the housing 11. The second portion 42 is located near the end portion of the first rib 40 in the −X direction. A second width W2 of the second portion 42 in the Y direction is smaller than the interval between the pair of flanges 22 in the Y direction.

The first width W1 of the first portion 41 is larger than the second width W2 of the second portion 42. In the first rib 40 of the embodiment, the width in the Y direction gradually increases from the second portion 42 to the first portion 41. In the first rib 40, the width in the Y direction gradually increases from the end portion in the −X direction to the end portion in the +X direction.

In the state where the cassette 30 is accommodated in the housing 11, the first portion 41 is disposed between the pair of flanges 22. The first width W1 of the first portion 41 is large, but is slightly smaller than the interval between the pair of flanges 22 in the Y direction. An end surface of the first portion 41 in the +Y direction is in contact with the flange 22 in the +Y direction. Accordingly, the cassette 30 is positioned in the +Y direction with respect to the housing 11. An end surface of the first portion 41 in the −Y direction is in contact with the flange 22 in the −Y direction. Accordingly, the cassette 30 is positioned in the −Y direction with respect to the housing 11.

In the state where the cassette 30 is pulled out from the housing 11, the second portion 42 is disposed between the pair of flanges 22. The second width W2 of the second portion 42 is smaller than the interval between the pair of flanges 22 in the Y direction. In an initial stage of the accommodation of the cassette 30, the contact between the second portion 42 and the pair of flanges 22 is prevented. Accordingly, a load when accommodating the cassette 30 is limited.

The width in the Y direction gradually increases from the second portion 42 to the first portion 41. In the accommodation of the cassette 30, when the cassette 30 moves in the −X direction, an opportunity of contact between side surfaces of the first rib 40 and the pair of flanges 22 gradually increases. Accordingly, positioning of the cassette 30 in the Y direction is smoothly realized, and the load when accommodating the cassette 30 is limited.

The first rib 40 is continuous from the second portion 42 to the first portion 41. During the accommodation of the cassette 30, the cassette 30 may rotate about the rotation axis parallel to the Z direction. In this case as well, the side surfaces of the first rib 40 are in contact with the pair of flanges 22, and excessive rotation of the cassette 30 is prevented. Accordingly, the load when accommodating the cassette 30 is limited.

Figure 6:
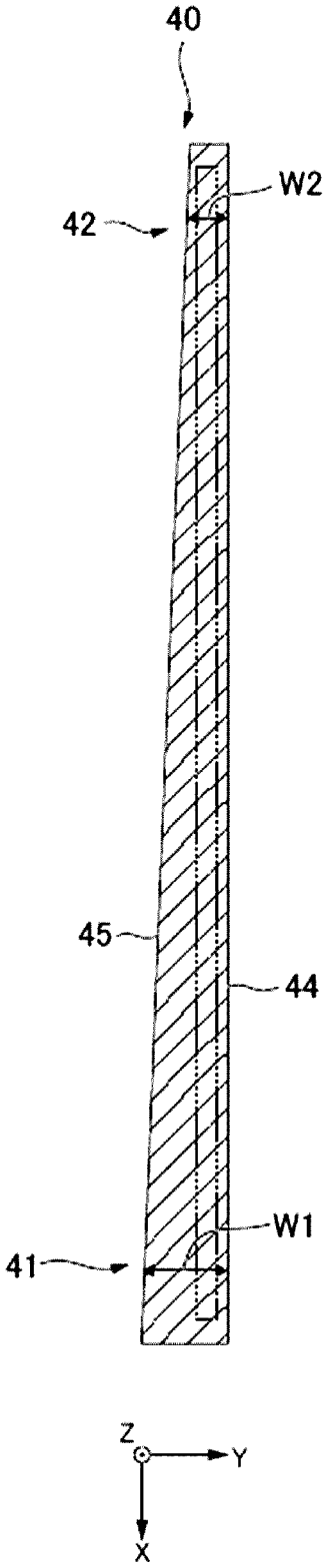
FIG. 6 is a plan sectional view of a first rib according to a first modification.

FIG. 6 is a plan sectional view of the first rib 40 according to a first modification of the embodiment. In the first rib 40 of the first modification, a first side surface 44 in the +Y direction is parallel to the X direction. In the first rib 40, a second side surface 45 in the −Y direction intersects the X direction. Also in the first rib 40, the width in the Y direction gradually increases from the second portion 42 to the first portion 41. Accordingly, in the accommodation of the cassette 30, the positioning of the cassette 30 in the Y direction is smoothly realized. In addition, the excessive rotation of the cassette 30 is prevented. Therefore, the load when accommodating the cassette 30 is limited.

Figure 7:
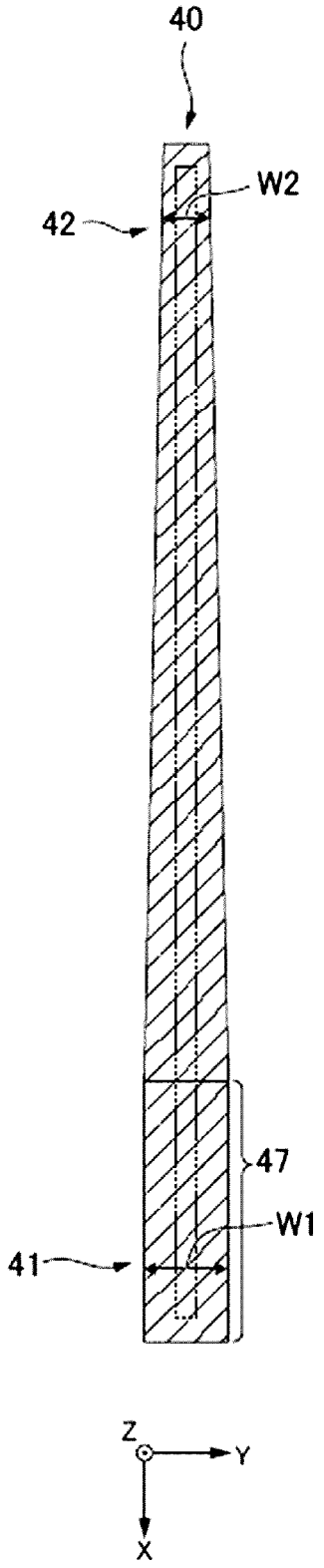
FIG. 7 is a plan sectional view of a first rib according to a second modification.

FIG. 7 is a plan sectional view of the first rib 40 according to a second modification of the embodiment. The first rib 40 of the second modification includes a first region 47 at the end portion in the +X direction. The first region 47 includes the first portion 41, and the first width W1 in the Y direction is constant. In the first rib 40, the width in the Y direction gradually increases from the second portion 42 to the first region 47. Accordingly, in the accommodation of the cassette 30, the positioning of the cassette 30 in the Y direction is smoothly realized. In addition, the excessive rotation of the cassette 30 is prevented. In particular, since the first width W1 of the first region 47 in the Y direction is constant, positioning accuracy in the Y direction when accommodating the cassette 30 is improved.

Figure 8:
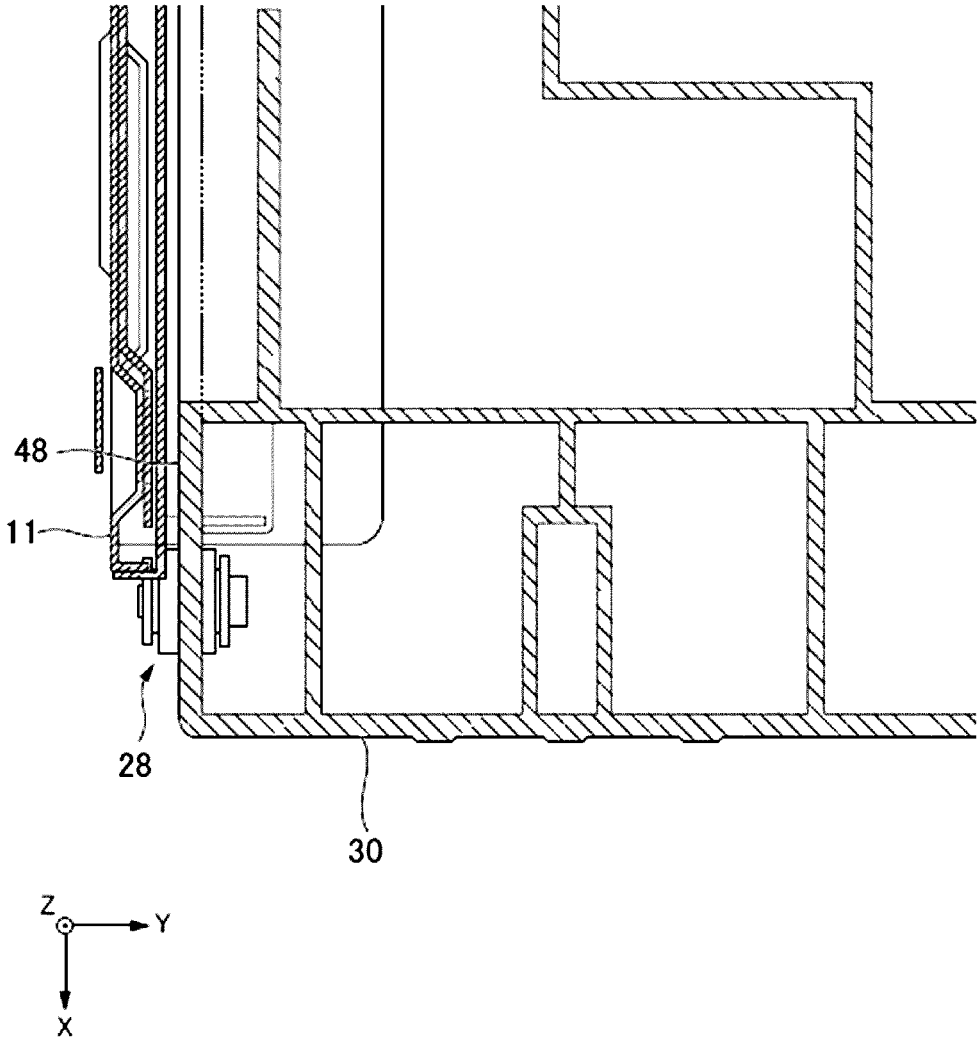
FIG. 8 is a plan sectional view of a periphery of a second roller.

FIG. 8 is a plan sectional view of a periphery of the second roller 28. The second roller 28 has a cylindrical shape whose central axis is parallel to the Y direction. A diameter of the outer periphery surface of the second roller 28 is constant. The second roller 28 does not have a flange.

The first rib 40 and the pair of flanges 22 function as a positioning mechanism of the cassette 30 in the Y direction. The second roller 28 does not have a flange, and thus does not function as a positioning mechanism of the cassette 30 in the Y direction. No positioning mechanism exists in the +Y direction or the −Y direction except for the first rib 40 and the pair of flanges 22. The positioning due to the first rib 40 and the pair of flanges 22 is not hindered by another positioning mechanism. Accordingly, the load when accommodating the cassette 30 is limited.

As shown in FIG. 2, the sheet supply device 10 includes the retracting device 14 that retracts the cassette into the housing 11. When a retracting force for retracting the cassette 30 caused by the retracting device 14 is increased, the cassette 30 is reliably accommodated in the housing 11. However, when the retracting force of the retracting device 14 is increased, a larger force is required to pull out the cassette 30 from the retracting device 14. Therefore, it is difficult to increase the retracting force of the retracting device 14. According to the sheet supply device 10 of the embodiment, the load when accommodating the cassette 30 is limited. Accordingly, the cassette 30 can be retracted even when the retracting force of the retracting device 14 is small.

The distance between the retracting device 14 and the first rib 40 in the Y direction is shorter than the distance between the retracting device 14 and the second rib 48 in the Y direction. The retracting device 14 retracts the first rib 40 in the −X direction. A moment around a contact point between the first rib 40 and the pair of flanges 22 is less likely to act on the cassette 30. Accordingly, the rotation of the cassette 30 is prevented, and a contact force between the first rib 40 and the pair of flanges 22 is reduced. Therefore, the load when accommodating the cassette 30 is limited.

The sheet supply device 10 supplies the sheet S in the +Y direction, which is a direction from the second rib 48 to the first rib 40. The cassette 30 is positioned in the Y direction by the first rib 40 and the pair of flanges 22. By supplying the sheet S in the direction from the second rib 48 to the first rib 40, the supply accuracy of the sheet S is improved.

Figure 9:
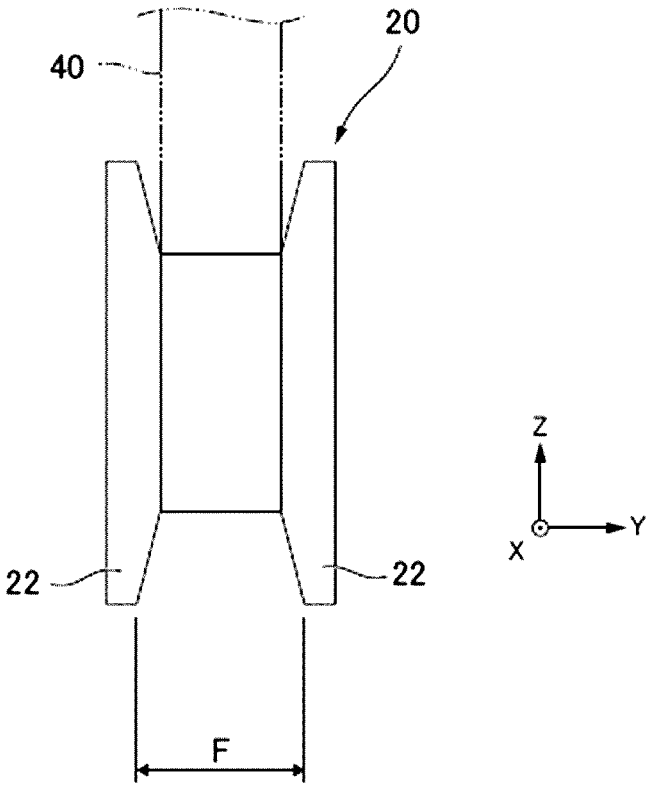
FIG. 9 is a side view of a first roller according to a third modification.

FIG. 9 is a side view of the first roller 20 according to a third modification of the embodiment. In the first roller 20 of the third modification, an interval F between the pair of flanges 22 in the Y direction increases from an inner side to the outer side of the first roller 20 in the radial direction. The side surfaces of the first rib 40 in the Y direction are in point contact with the flanges 22 on inner sides of the flanges 22 in the radial direction. Accordingly, the contact between the first rib 40 and the pair of flanges 22 is prevented, and the load when accommodating the cassette 30 is limited. Also in this case, since the first rib 40 and the pair of flanges 22 are in point contact with each other, the cassette 30 is positioned in the Y direction.

As shown in FIG. 2, the first rib 40 includes a groove 50 capable of accommodating grease (lubricating oil). The groove 50 is formed in the lower end surface of the first rib 40. The groove 50 opens in a contact portion between the first rib 40 and the first roller 20. Accordingly, the grease is supplied to the contact portion between the first rib 40 and the first roller 20, and the load when accommodating the cassette 30 is limited.

As shown in FIG. 5, the groove 50 extends in the X direction. An end portion of the groove 50 in the +X direction is disposed in the +X direction of the first portion 41. An end portion of the groove 50 in the −X direction is disposed in the −X direction of the second portion 42. Accordingly, regardless of the position of the cassette 30 in the X direction, the groove 50 opens in the contact portion between the first rib 40 and the first roller 20. The grease is supplied to the contact portion between the first rib 40 and the first roller 20, and the load when accommodating the cassette 30 is limited.

According to at least one embodiment described above, the first rib 40 having the first width W1 of the first portion 41 wider than the second width W2 of the second portion 42 is provided. Accordingly, the load when accommodating the cassette 30 can be limited.

While certain embodiments have been described, these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet supply device, comprising:

a cassette configured to accommodate a sheet;

a housing that movably supports the cassette in a first direction;

a first roller supported by the housing and configured to rotate about a rotation axis parallel to a second direction orthogonal to the first direction, the first roller comprising a pair of flanges spaced apart from each other in the second direction; and a first rib protruding in a downward direction of the cassette, comprising a lower end surface in contact with the first roller between the pair of flanges, extending in the first direction, and having a first width in the second direction of a first portion wider than a second width in the second direction of a second portion, the first portion disposed between the pair of flanges in a state where the cassette is accommodated in the housing, the second portion disposed between the pair of flanges in a state where the cassette is at least partially withdrawn from the housing, wherein a width of the first rib in the second direction gradually increases from the second portion to the first portion, wherein the first width of the first portion is smaller than an interval between the pair of flanges in the second direction, and wherein an end surface of the first portion in the second direction is in contact with the pair of flanges in the second direction.

2. The sheet supply device according to claim 1, wherein the first rib having a width in the second direction gradually increasing from the second portion to the first portion.

3. The sheet supply device according to claim 1, wherein the first rib comprises a first side surface in the second direction that is parallel to the first direction, and a second side surface in the second direction that intersects the first direction.

4. The sheet supply device according to claim 1, wherein the first rib comprises a first region including the first portion and having a constant width in the second direction, and the first rib having a width in the second direction gradually increasing from the second portion to the first portion.

5. The sheet supply device according to claim 1, further comprising:

a second rib protruding downward from the cassette, extending in the first direction, and spaced apart from the first rib in the second direction; and a second roller supported by the housing, configured to rotate about the rotation axis parallel to the second direction, and in contact with a lower end surface of the second rib, the second roller having a constant diameter of an outer periphery surface.

6. The sheet supply device according to claim 5, further comprising:

a retracting device configured to retract the cassette into the housing, wherein a distance between the retracting device and the first rib in the second direction is shorter than a distance between the retracting device and the second rib in the second direction.

7. The sheet supply device according to claim 1, further comprising:

a retracting device configured to retract the cassette into the housing.

8. The sheet supply device according to claim 1, wherein the sheet supply device is configured to supply the sheet in a direction from a second rib to the first rib.

9. The sheet supply device according to claim 1, wherein the interval between the pair of flanges in the second direction increases from an inner side to an outer side of the first roller in a radial direction.

10. The sheet supply device according to claim 1, wherein the first rib comprises a groove configured to accommodate a lubricating oil in the lower end surface.

11. An image forming apparatus, comprising:

a printer;

a scanner; and a sheet supply device, comprising:

a cassette configured to accommodate a sheet;

a housing that movably supports the cassette in a first direction;

a first roller supported by the housing and configured to rotate about a rotation axis parallel to a second direction orthogonal to the first direction, the first roller comprising a pair of flanges spaced apart from each other in the second direction; and a first rib protruding in a downward direction of the cassette, comprising a lower end surface in contact with the first roller between the pair of flanges, extending in the first direction, and having a first width in the second direction of a first portion wider than a second width in the second direction of a second portion, the first portion disposed between the pair of flanges in a state where the cassette is accommodated in the housing, the second portion disposed between the pair of flanges in a state where the cassette is at least partially withdrawn from the housing, wherein a width of the first rib in the second direction gradually increases from the second portion to the first portion, wherein the first width of the first portion is smaller than an interval between the pair of flanges in the second direction, and wherein an end surface of the first portion in the second direction is in contact with the pair of flanges in the second direction.

12. The image forming apparatus according to claim 11, wherein the first rib having a width in the second direction gradually increasing from the second portion to the first portion.

13. The image forming apparatus according to claim 11, wherein the first rib comprises a first side surface in the second direction that is parallel to the first direction, and a second side surface in the second direction that intersects the first direction.

14. The image forming apparatus according to claim 11, wherein the first rib comprises a first region including the first portion and having a constant width in the second direction, and the first rib having a width in the second direction gradually increasing from the second portion to the first portion.

15. The image forming apparatus according to claim 11, further comprising:

a second rib protruding downward from the cassette, extending in the first direction, and spaced apart from the first rib in the second direction; and a second roller supported by the housing, configured to rotate about the rotation axis parallel to the second direction, and in contact with a lower end surface of the second rib, the second roller having a constant diameter of an outer periphery surface.

16. The image forming apparatus according to claim 15, further comprising:

a retracting device configured to retract the cassette into the housing, wherein a distance between the retracting device and the first rib in the second direction is shorter than a distance between the retracting device and the second rib in the second direction.

17. The image forming apparatus according to claim 11, further comprising:

a retracting device configured to retract the cassette into the housing.

18. The image forming apparatus according to claim 11, wherein the sheet supply device is configured to supply the sheet in a direction from a second rib to the first rib.

19. The image forming apparatus according to claim 11, wherein the interval between the pair of flanges in the second direction increases from an inner side to an outer side of the first roller in a radial direction.

20. The image forming apparatus according to claim 11, wherein the first rib comprises a groove configured to accommodate a lubricating oil in the lower end surface.

* * * * *